US007866775B2

(12) United States Patent
Ohnishi

(10) Patent No.: US 7,866,775 B2
(45) Date of Patent: Jan. 11, 2011

(54) PRINTING SYSTEM, INKJET PRINTER, AND PRINTING METHOD

(75) Inventor: Masaru Ohnishi, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 0 days.

(21) Appl. No.: 12/392,984

(22) Filed: Feb. 25, 2009

(65) Prior Publication Data

US 2009/0225109 A1 Sep. 10, 2009

(30) Foreign Application Priority Data

Feb. 29, 2008 (JP) ..... 2008-051146

(51) Int. Cl.
*B41J 25/308* (2006.01)

(52) U.S. Cl. ..... 347/8

(58) Field of Classification Search ..... 347/8, 347/95, 100, 102

See application file for complete search history.

(56) References Cited

U.S. PATENT DOCUMENTS

2008/0231679 A1* 9/2008 Nakhmanovich et al. ... 347/101

2009/0128611 A1* 5/2009 Kariya et al. ..... 347/106

FOREIGN PATENT DOCUMENTS

JP 03216379 A * 9/1991

JP 05271318 A * 10/1993

JP 2004-134490 4/2004

* cited by examiner

*Primary Examiner*—Matthew Luu
*Assistant Examiner*—Lisa M Solomon
(74) *Attorney, Agent, or Firm*—Ditthavong Mori & Steiner, P.C.

(57) ABSTRACT

A printing system includes an inkjet head and a decompressor. The inkjet head has nozzles to eject ink to a medium. The decompressor is configured to reduce pressure of at least an area between the medium and said nozzles of said inkjet head to a value lower than an atmospheric pressure of 1 atm. The ink contains as a main component at least one of a monomer and an oligomer, and is curable by polymerization of the main component. A saturated vapor pressure of the main component of said ink is 10 mmHg or less.

20 Claims, 4 Drawing Sheets

| PRESSURE | 1 | 0.5 | 0.1 | 0.01 |
|---|---|---|---|---|
| MAXIMUM FLYING DISTANCE (mm) | 2 | 4 | 20 | 200 |

PRINTING SYSTEM, INKJET PRINTER, AND PRINTING METHOD

CROSS-REFERENCE TO RELATED APPLICATION

The present application claims priority under 35 U.S.C. §119 to Japanese Patent Application No. 2008-051146, filed on Feb. 29, 2008, the entire contents of which are herein incorporated by reference.

BACKGROUND OF THE INVENTION

1. Field of the Invention

The present invention relates to a printing system, an inkjet printer, and a printing method.

2. Discussion of the Background

Recently, a technology for printing a high resolution image by means of an inkjet printer has been widely used. The inkjet printer is an apparatus in which minuscule droplets of ink are ejected from nozzles of an inkjet head toward a medium so as to conduct printing on the medium.

Ink droplets ejected from the nozzle of the inkjet head is subjected to air resistance until reaching a medium. Accordingly, the printing accuracy by the inkjet printer may be affected by the air resistance. For example, the air resistance may cause misalignment of deposition of ink on the medium, making the ink into fine mist, and the like.

To solve these problems, the inventor of the present invention got an idea for minimizing air resistance by reducing the pressure of atmosphere in which printing is conducted. However, the inventor intensely studied and found that, in an inkjet printer which is structured to eject liquid ink, it is impossible to suitably reduce the air resistance despite attempts to reduce pressure because the range of suitable pressure allowing stable use of ink is small. Based on the finding, the inventor found that another, more suitable, way for reducing the influence of air resistance on ink droplets is required.

JP-A-2004-134490 relates to a patterning apparatus using an inkjet head. The contents of JP-A-2004-134490 are herein incorporated by reference in their entirety.

SUMMARY OF THE INVENTION

According to one aspect of the present invention, a printing system includes an inkjet head and a decompressor. The inkjet head has nozzles to eject ink to a medium. The decompressor is configured to reduce pressure of at least an area between the medium and the nozzles of the inkjet head to a value lower than an atmospheric pressure of 1 atm. The ink contains as a main component at least one of a monomer and an oligomer, and is curable by polymerization of the main component. A saturated vapor pressure of the main component of the ink is 10 mmHg or less.

According to another aspect of the present invention, an inkjet printer includes an inkjet head. The inkjet head has nozzles to eject ink to a medium. The ink contains as a main component at least one of a monomer and an oligomer, and is curable by polymerization of the main component. A saturated vapor pressure of the main component of the ink is 10 mmHg or less. A pressure of at least an area between the medium and the nozzles of the inkjet head is reduced to a value lower than an atmospheric pressure of 1 atm.

According to further aspect of the present invention, a printing method includes using ink which contains as a main component at least one of a monomer and an oligomer, and is curable by polymerization of the main component, and in which a saturated vapor pressure of the main component of the ink is 10 mmHg or less. A pressure of at least an area between a medium and nozzles of an inkjet head is reduced to a value lower than an atmospheric pressure of 1 atm. The ink is ejected to the medium from the nozzles of the inkjet head.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIG. 4A is a graph showing an example of relationship between the radius of the droplet and the maximum flying distance under the normal atmospheric pressure, and FIG. 4B is a table showing an example of relationship between the pressure in the area between the nozzle 202 of the inkjet head 102 and the medium 50 and the maximum flying distance of the droplet.

DETAILED DESCRIPTION OF EXEMPLARY EMBODIMENTS OF THE INVENTION

Figure 1:
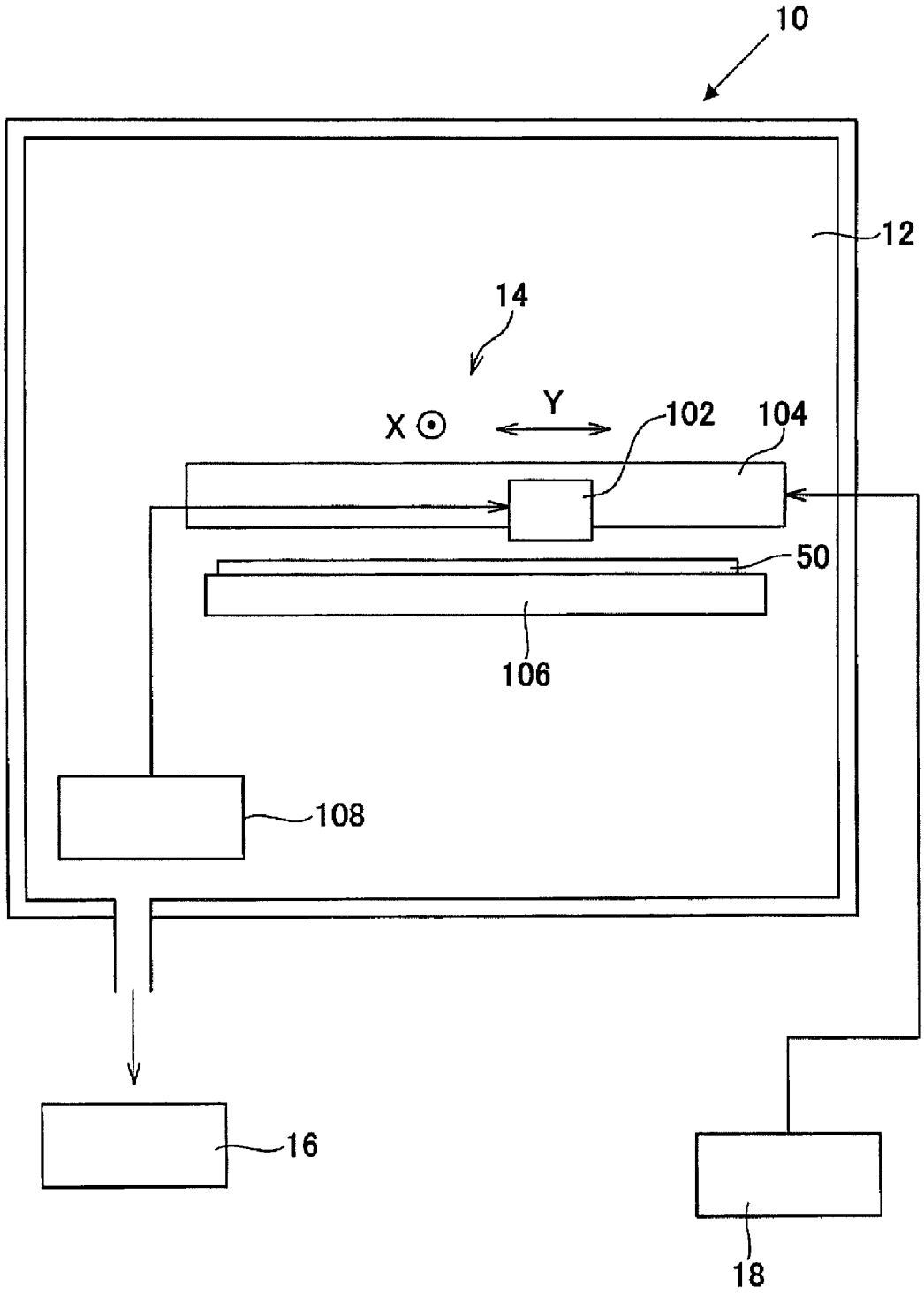
FIG. 1 is an illustration showing an example of structure of a printing system 10 according to an embodiment of the present invention.

Embodiments of the present invention will be described hereinafter with reference to the accompanying drawings. In the following description, the constituent elements having substantially the same function and arrangement are denoted by the same reference numerals, and repetitive descriptions will be made only when necessary. The embodiments of the present invention have the following arrangements.

FIG. 1 shows an example of the structure of a printing system 10 according to an embodiment of the present invention. The printing system 10 is a printing system of a type conducting printing in an inkjet printing method onto a medium 50 such as paper or film and includes an inkjet printer 14, and a vacuum pump 16. The printing system 10 may be an industrial printing system for printing outdoor advertisements, posters, or published matters.

In the printing system 10 of this embodiment, at least the inkjet printer 14 is disposed within a decompression chamber 12. The decompression chamber 12 is an airtight chamber accommodating the inkjet printer 14 therein and is decompressed by a vacuum pump 16. The printing system 10 conducts printing according to the control of an outside host PC 18. The host PC 18 is a computer for controlling the printing actions of the inkjet printer 14.

The inkjet printer 14 is a printing device for printing in the inkjet method and includes an inkjet head 102, a guide rail 104, a platen 106, and an ink cartridge 108. The inkjet head 102 is a print head having nozzles for ejecting ink droplets onto the medium 50. In this embodiment, the inkjet head 102 ejects ink droplets, each having a volume of 1 picoliter (hereinafter, referred to as "pl") or less, from the nozzles. The volume of each ink droplet is preferably 0.5 pl or less, more preferably 0.1 pl or less.

The inkjet head 102 reciprocates in a Y direction as a predetermined scan direction along the guide rail 104 so that the inkjet head 102 ejects ink droplets at desired positions on the medium 50 in the Y direction. Further, the inkjet head 102 moves in an X direction perpendicular to the Y direction relative to the medium 50 so that the inkjet head 102 ejects ink droplets at desired position on the medium 50 in the X direction.

The inkjet printer 14 moves the inkjet head 102 in the X direction relative to the medium 50 by, for example, feeding the medium 50. In this case, the inkjet printer 14 further includes rollers or the like for feeding the medium 50. In the inkjet printer 14, the inkjet head 102 may be moved not feeding the medium 50.

The guide rail 104 is a member for guiding the movement of the inkjet head 102 in the Y direction and may move the inkjet head 102 to scan according to a command of the host PC 18. The platen 106 is a base portion disposed to face the inkjet head 102 via the medium 50 and holds the medium 50 onto which ink droplets are ejected. The ink cartridge 108 is a cartridge of storing ink to be ejected from the inkjet head 102 and is connected to the inkjet head 102 to supply ink to the inkjet head 102 via an ink supplying path such as a tube.

The vacuum pump 16 is an example of decompressor and reduces the inner pressure of the decompression chamber 12 according to the operation of an operator, for example. Therefore, the vacuum pump 16 reduces the pressure in an area between the nozzles of the inkjet head 102 and the medium 50 in the inkjet printer 14 to a value lower than 1 atm. In this embodiment, the vacuum pump 16 reduces the pressure of the area to 0.5 atm or less (for example, from 0.001 to 0.5 atm), preferably 0.1 atm or less, more preferably 0.01 atm.

In a variation embodiment of the present invention, the vacuum pump 16 may be structured as a component of the inkjet printer 14. In this case, for example, the inkjet printer 14 itself is the printing system 10. In addition, instead of the decompression chamber 12 accommodating the entire inkjet printer 14, a decompression chamber as a component of the inkjet printer 14 may be provided. For example, the decompression chamber is an airtight chamber surrounding at least an area between the inkjet head 102 and the medium 50. In this case, by reducing the inner pressure of the decompression chamber, the vacuum pump 16 reduces the pressure at the area between the nozzles of the inkjet head 102 and the medium 50 to a value lower than 1 atm. The decompression chamber may be disposed in a printing unit which is detachably attached to the inkjet printer 14. The medium 50 used in the printing system 10 may be a medium having not flat surface to be printed such as a three-dimensional medium.

Hereinafter, the detail description will be made as regard to ink used in this embodiment. In this embodiment, the ink is curable by polymerization of monomer. For example, the ink may be UV curable ink which is curable by polymerization of the monomer when irradiated with ultraviolet light.

In this case, the UV curable ink contains, for example, a pigment, a dispersant, an initiator (sensitizer), an antigelling agent, a surface conditioner, a monomer, and an oligomer. The contained amount of the monomer is, for example, from 65 to 85%, and the contained amount of the oligomer is, for example, from 10 to 20%. The contained amount of the pigment is, for example, about 4% and the contained amount of the initiator is, for example, about 7%. The contained amounts of the dispersant, the antigelling agent, and the surface conditioner are several percents, respectively.

Also in this case, the saturated vapor pressure of the monomer as the main component is, for example, 10 mmHg or less (for example, from 0.01 to 10 mmHg), preferably 5 mmHg or less (for example, from 2 to 3 mmHg). The saturated vapor pressure of the oligomer and the initiator as the major components is also, for example, 10 mmHg or less (for example, from 0.01 to 10 mmHg), preferably 5 mmHg or less (for example, from 2 to 3 mmHg). The saturated vapor pressure of the other components is also 10 mmHg or less (for example, from 0.01 to 10 mmHg), preferably 5 mmHg or less (for example, from 2 to 3 mmHg).

According to this embodiment, influence of the vapor pressure of the ink can be suitably reduced when the pressure in the decompression chamber 12 is reduced by the vacuum pump 16. Therefore, the inner pressure of the decompression chamber 12 can be suitably reduced, thereby sufficiently and suitably reducing the air resistance to which the ink droplets are subjected.

Also in this embodiment, the ink that is curable by polymerization of monomer is used so that the ink can be fixed to the medium 50 without evaporation of components of the ink. According to this embodiment, therefore, adequate printing can be conducted using ink of which components have low saturated vapor pressures.

As the ink that is curable by polymerization of monomer, for example, thermosetting ink that is curable by heating or ink that is curable by irradiation of electron beam may be used. In these cases, the saturated vapor pressures of respective components are preferably the same as or similar to the saturated vapor pressures as mentioned above. Accordingly, similarly to the UV curable ink, adequate printing can be conducted using ink of which components have low saturated vapor pressures.

Figure 2:
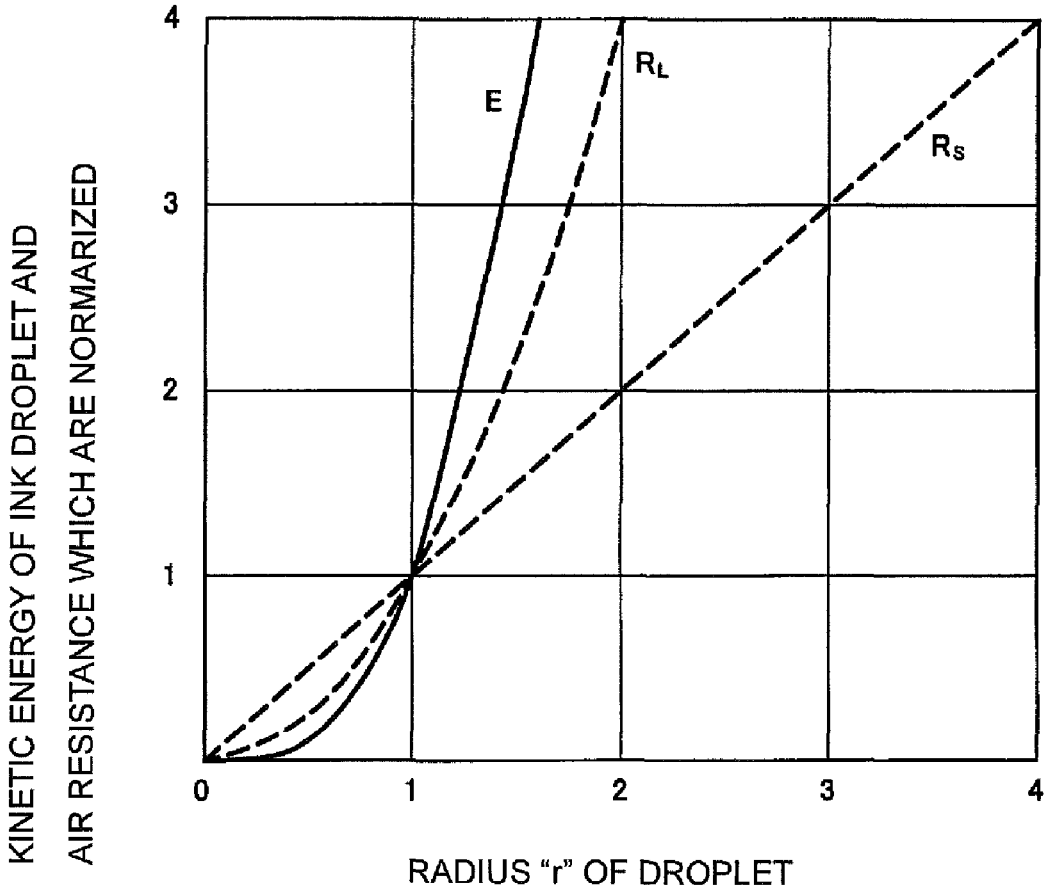
FIG. 2 is a graph for explaining the relationship between the kinetic energy of an ink droplet and air resistance.

FIG. 2 is a graph for explaining the relationship between kinetic energy of an ink droplet and air resistance. In this graph, respective components of the kinetic energy and the air resistance are normalized such that curves and a line indicating the respective components intersect at a coordinate point (1, 1).

When the speed of the ink droplet is represented by "v", the kinetic energy "E" of the droplet is $E=(1/2)\ mv^2$. When the radius of the droplet is represented by "r", the mass "m" of the droplet is proportional to "$r^3$" because the mass "m" is proportional to the volume. Therefore, if the speed "v" of the droplet is constant, the kinetic energy of the droplet is proportional to "$r^3$".

It is known that the air resistance to which droplet is subjected includes air resistance component $R_S$ which is proportional to the radius "r" of the droplet and air resistance component $R_L$ which is proportional to the sectional area of the droplet. Since the sectional area of the droplet is proportional to "$r^2$", the air resistance component $R_L$ is proportional to "$r^2$".

When the radius "r" of the droplet is enough small, the air resistance component $R_S$ is larger than the air resistance component $R_L$ so that the droplet is subjected to air resistance which is substantially proportional to the radius "r". On the other hand, when the radius "r" of the droplet is enough large, the air resistance component $R_L$ is larger than the air resistance component $R_S$ so that the droplet is subjected to air resistance which is substantially proportional to the radius "r" squared ($r^2$). Further, when the radius "r" of the droplet is a size between the both components, the droplet is subjected to air resistance in which the air resistance component $R_S$ and the air resistance component $R_L$ are combined. In this case, the air resistance to which the ink droplet is subjected is a value in a region between the curve indicating the air resistance component $R_L$ and the line indicating the air resistance component $R_S$.

Taking the relationship between the kinetic energy of an ink droplet and the air resistance into consideration, as can be seen from the graph, the kinetic energy E of the droplet is large as compared to the air resistance when the radius "r" is increased. When the kinetic energy E of the droplet is enough large as compared to the air resistance, the droplet is hardly affected by the air resistance. On the other hand, when the radius "r" is small, the kinetic energy E of the droplet is small as compared to the air resistance. The smaller the radius "r" is, the easier the droplet is affected by the air resistance.

Figure 3A:
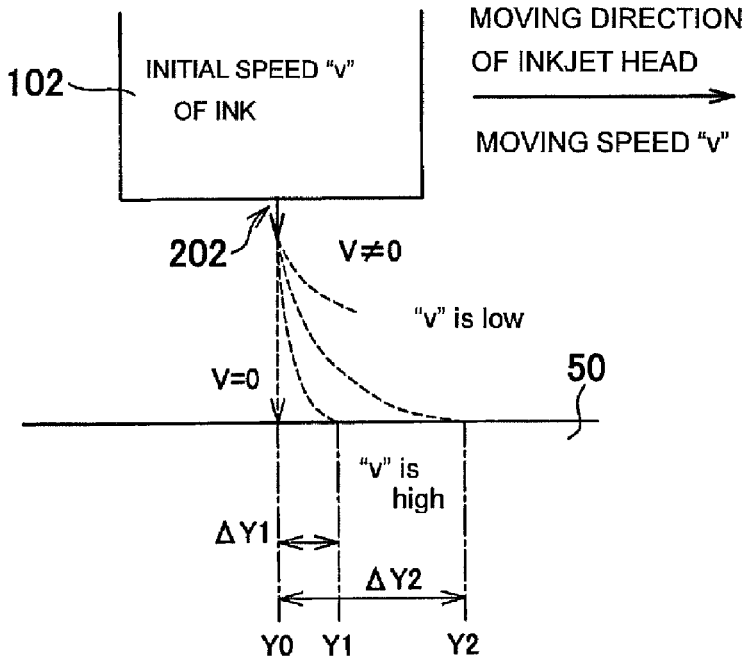
FIGS. 3A and 3B are illustrations showing an example of influence of air resistance on ink droplets, where FIG. 3A schematically shows an example of state of an ink droplet ejected from the inkjet head 102 which is moving in the Y direction, and FIG. 3B schematically shows an example of state of an ink droplet in case that the ink is ejected in a horizontal direction.
Figure 3B:
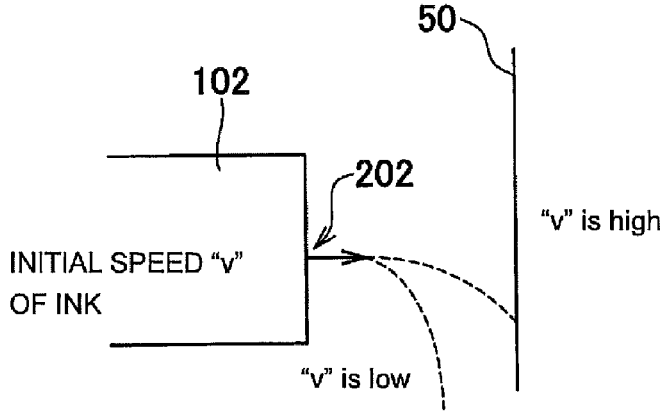

FIGS. 3A and 3B are illustrations showing an example of influence of air resistance on ink droplets. In the inkjet printer 14 of this embodiment (see FIG. 1), the inkjet head 102 has a plurality of nozzles. In the following description, however, description will be made as regard to an ink droplet ejected from only one nozzle 202 of the inkjet head 102 for ease of explanation.

FIG. 3A schematically shows an example of state of an ink droplet ejected from the inkjet head 102 which is moving in the Y direction. In this example, the inkjet head 102 ejects the ink droplet downward in a vertical direction at an initial speed "v" from the nozzle 202. The inkjet head 102 moves at a moving speed "V" in the Y direction.

Now, a case that the inkjet head 102 ejects the ink droplet at a point Y0 in the Y direction (Y coordinate) will be considered. In this case, if the moving speed V of the inkjet head 102 is 0, an ink droplet ejected is deposited at a position Y0 in the Y coordinate on the medium 50 without any shift.

However, if the ink is ejected while the inkjet head 102 is moving at the moving speed V as actual printing, the deposition point (arrival point) of the ink droplet shifts from the point Y0 in the Y coordinate. The lower the initial speed "v" of the ink droplet is, the greater the deposition point shifts. For example, assuming that the deposition point in the Y coordinate when the ink droplet is ejected at a certain initial speed is Y1 and the deposition point in the Y coordinate when the ink droplet is ejected at an initial speed lower than the certain initial speed is Y2, the shifting amount of the latter case $\Delta Y2=Y2-Y0$ is greater than the shifting amount of the former case $\Delta Y1=Y1-Y0$.

The speed of the ink droplet is affected by air resistance between the ejection from the inkjet head and the deposition on the medium 50. Accordingly, the speed of the ink droplet ejected from the inkjet head 102 is gradually reduced due to balance between the kinetic energy of the ink droplet and the air resistance.

As a result, when the air resistance is large as compared to the kinetic energy of the ink droplet, there may be not only a problem that the deposition point is shifted but also a problem that the ink droplet becomes fine mist because the speed is reduced to too low, for example. Therefore, when influence of air resistance on the ink droplet is great, for example, as in the normal atmospheric pressure, ink droplet may be difficult be ejected if the kinetic energy of the ink droplet is small.

To reduce the influence of air resistance, it can be considered that making the kinetic energy of ink droplet larger by increasing the mass of the ink droplet or the initial speed of ejection is effective. However, it is necessary to reduce the size of ink droplets in order to achieve the printing of a high resolution image which has been desired recently. Therefore, it is difficult to increase the mass of the ink droplet. Also for the initial speed of ejection, it is not easy to increase the initial speed of ejection because various optimization measures must be conducted in the structure of the inkjet printer. If the initial speed of ejection of small droplet is increased too much, the shape of droplet maintained by the surface tension cannot be maintained so as to spoil the suitable ejection.

To prevent the ink droplet from becoming fine mist, it can be considered that making the distance between the inkjet head 102 and the medium 50 small is effective. However, if the distance between them is too small, there must be a problem of contact between the medium 50 and the inkjet head 102 while feeding of the medium 50 or scanning of the inkjet head 102. Therefore, the inkjet head 102 and the medium 50 are required to be spaced therebetween by at least a certain distance. That is, it is difficult to prevent the ink droplet from becoming fine mist only by reducing the distance between the inkjet head 102 and the medium 50.

FIG. 3B schematically shows an example of state of an ink droplet in case that the ink is ejected in a horizontal direction. In the inkjet printer 14, the inkjet head 102 may be adapted to eject the ink from the nozzle 202 in the horizontal direction. In this case, the droplet is subjected to gravity acting downward in a vertical direction in addition to the air resistance. Accordingly, as the speed of the droplet is reduced due to the air resistance, the droplet falls downward in the vertical direction rather than moving toward the medium 50. Depending on the balance between the kinetic energy of the droplet and the air resistance, the reduction in speed makes the ink become fine mist. Also in this case, therefore, it is difficult to suitably eject droplet when the kinetic energy of the droplet is small if the influence of air resistance on the ink droplet is great.

Figures 4A, 4B:
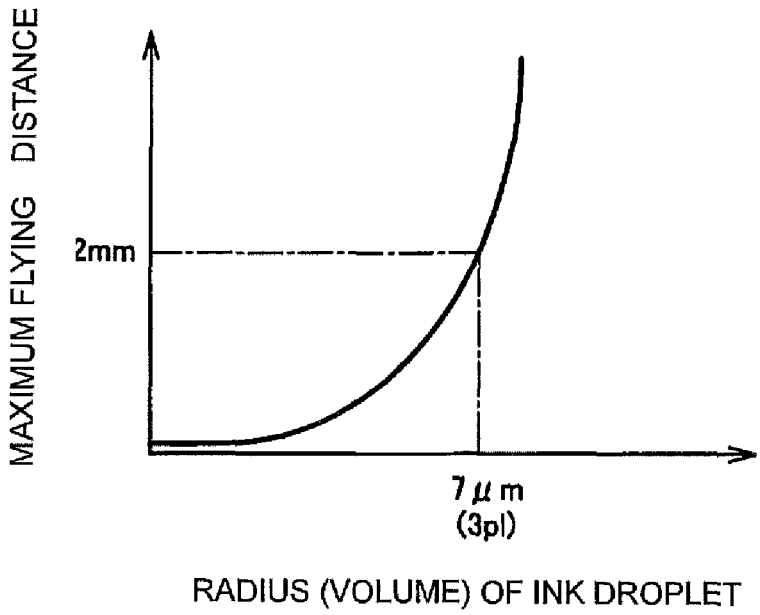
FIGS. 4A and 4B are illustrations for explaining the flying distance of the ink droplet, where

FIGS. 4A and 4B are illustrations for explaining the flying distance of the ink droplet. FIG. 4A is a graph showing an example of relationship between the radius of the droplet and the maximum flying distance under the normal atmospheric pressure. As described with regard to FIG. 2, the larger the radius of the ink droplet is, the larger the kinetic energy of the droplet is. When the kinetic energy of the droplet is large, the droplet is hard to be affected by the air resistance. The graph shows that the larger the radius of the ink droplet is, the larger the maximum distance that the droplet can be suitably ejected is.

In the inkjet printer, the inkjet head 102 and the medium 50 are required to be spaced apart from each other by a distance, for example, 2 mm or more. Accordingly, the maximum flying distance of the ink droplet is required to be 2 mm or more.

As shown in the graph, the radius of the droplet is required to be, for example, 7 μm or more to ensure the maximum flying distance of 2 mm or more under the normal atmospheric pressure. This radius corresponds to, for example, the radius of a droplet of about 3 pl in volume. It should be noted that, for example, the volume of the droplet is required to be 1 pl or more in order to ensure the maximum flying distance of 1 mm or more.

Since the air resistance is large under the normal atmospheric pressure, the distance between the inkjet head 102 and the medium 50 is significantly limited when the volume of the ink droplet is constant. As seen from an opposite angle, when the inkjet head 102 and the medium 50 are spaced from each other by a required distance, it must be difficult to reduce the volume of the ink droplet for the purpose of conducting the printing of a high resolution image.

FIG. 4B is a table showing an example of relationship between the pressure in the area between the nozzle 202 of the inkjet head 102 and the medium 50 and the maximum flying distance of the droplet, of a case that the volume of the droplet is 3 pl. When the volume of the droplet is 3 pl, the maximum flying distance is about 2 mm in the normal atmospheric pressure (1 atm) as described in the above with reference to FIG. 4A.

When the pressure of the area between the nozzle 202 and the medium 50 is reduced to 0.5 atm, 0.1 atm, and 0.01 atm by means of the structure of the printing system 10 of this embodiment, the influence of air resistance is reduced so that the maximum flying distance is increased to, for example, 4 mm, 20 mm, and 200 mm. According to this embodiment, it is possible to adequately increase the maximum flying distance of the droplet when the volume of the ink droplet is constant. Further, for example, the inkjet head 102 and the medium 50 can be suitably spaced apart from each other.

Similarly, for example, even in a case of the ink droplet having a small volume, reduction in pressure of the area between the nozzle 202 and the medium 50 prevents the ink from becoming fine mist and increases the maximum flying distance of the droplet, but description of concrete numeric values is omitted. Therefore, when the inkjet head 102 and the medium 50 are spaced apart from each other by a required distance, the volume of droplet to be suitably ejected is allowed to be reduced by reducing the pressure.

Therefore, for example, even when the volume of the droplet is 1 pl or less, 0.5 pl or less, or 0.1 pl or less, the ink can be suitably ejected in a state that the inkjet head 102 is spaced apart from the medium 50 by the required distance because influence of air resistance is reduced. According to this embodiment, the influence of air resistance on ink droplets to be ejected from the inkjet head 102 is sufficiently and suitably reduced. In addition, it is therefore possible to adequately conduct printing of a high resolution image. Further, when the volume of the ink droplet is not so small, that is, 1 pl or more, a high resolution image can be printed with a space of, for example, 1 cm, 2 cm, 5 cm or more.

Embodiments of the present invention advantageously provide a printing system, an inkjet printer, and a printing method capable of solving the problems discussed above.

An embodiment of a printing system of a type printing in using an inkjet method of the present invention includes an inkjet head having nozzles for ejecting ink to a medium, and a decompressor for reducing the pressure of at least an area between the medium and the nozzles of the inkjet head to a value lower than normal atmospheric pressure, wherein the ink contains as its main component at least one of monomer and oligomer and is curable by polymerization of the main component, and wherein the saturated vapor pressure of the main component of the ink is 10 mmHg or less.

The main component of ink can be a component making up the highest percentage of the ink. The contained amount of the main component in the ink is, for example, 50% or more, preferably 65% or more (for example, 65-85%). When both monomer and oligomer are contained as the main component, the contained amount of the main component may be the contained amount of total of monomer and oligomer. The vapor pressure of the entire ink is preferably 1/20 or less of normal atmospheric pressure, for example. The saturated vapor pressure of the main component in the ink is preferably 5 mm Hg or less. The decompressor preferably reduces the pressure of at least whole area between the medium and the nozzles.

In case of using conventionally known ink, it is difficult to sufficiently reduce the pressure even when it is tried to reduce the pressure of the area between the nozzles and the medium because components of ink are affected by the vapor pressure so as to evaporate so that the characteristics of ink vary. Therefore, since the pressure cannot be sufficiently reduced even by simply using a decompressor, it is difficult to sufficiently and suitably reduce influence of air resistance on ink droplets.

However, the arrangement as mentioned above can adequately reduce the influence of vapor pressure of the ink. In addition, this can suitably reduce the pressure of the area between the nozzles and the medium. According to the arrangement, therefore, the influence of air resistance on the ink droplets can be sufficiently and suitably reduced.

When the saturated vapor pressures of components of the ink are low, it is too much time to dry the ink by evaporation of the components of the ink similarly to water-base inks and solvent inks. If the medium is heated for promoting the evaporation, it is required to heat to a high temperature so that the medium may be deformed by the heat. If the ink cannot be sufficiently dried, bleeding may be caused, leading to reduction in printing quality. Therefore, if the ink used in the printing system according to an embodiment of the present invention is of a type that is fixed to the medium by drying, it may be difficult to adequately conduct the printing.

According to the above first arrangement, however, since ink which is curable by polymerization of the main component is used, the ink can be fixed to the medium without evaporation of components of the ink. Therefore, according to this arrangement, adequate printing can be conducted using ink of which components have low saturated vapor pressures.

The ink may be thermosetting ink or UV curable ink, for example. The ink may be ink that is curable by irradiation of electron beam. The saturated vapor pressure of the main component in the ink means a saturated vapor pressure under environment for the printing. For example, the saturated vapor pressure in this example is a saturated vapor pressure at a temperature of 25° C. Further, the saturated vapor pressure may be a vapor pressure in normal atmospheric pressure, i.e. 1 atm, at a temperature of 25° C.

In a second arrangement, the ink further contains an initiator for the polymerization and the saturated vapor pressure of the initiator is 10 mmHg or less. The saturated vapor pressure of the initiator is preferably 5 mmHg or less. The ink contains the initiator in addition to the aforementioned main component. The ink may contain the initiator in addition to monomer and oligomer. The ink may further contain various additives.

According to this arrangement, the influence of the vapor pressure of the ink can be further suitably reduced. Therefore, the influence of air resistance on the ink droplets can be further suitably reduced.

The ink further contains, for example, a pigment, dispersant, an antigelling agent, a surface conditioner, and the like. It is preferable that the saturated vapor pressure of any of substantial components is 10 mmHg or less. The saturated vapor pressure of any of substantial components is further preferably 5 mmHg or less.

The substantial component means a component remaining in the ink as composition of the ink in the inkjet head, for example. The substantial components of the ink are preferably all of the compositions of the ink. In practice, the substantial components of the ink may be a part occupying 95% or more of the compositions, except a part of which contained amount is small.

In a third arrangement, the inkjet head ejects ink droplets, each having a volume of 1 picoliter (hereinafter, referred to as "pl") or less, from the nozzles. The volume of each ink droplet is preferably 0.5 pl or less, more preferably 0.1 pl or less.

The smaller the volume of the ink droplet is, the greater the influence of air resistance on the ink droplet is. If the volume of the ink droplet is reduced, the flying speed of the ink droplet is drastically reduced so as to cause a problem that the ink droplet becomes fine mist so that it is difficult to conduct adequate printing. However, according to this arrangement, the air resistance on the ink droplet can be sufficiently and suitably reduced. Further, this arrangement allows ink droplets of small volume to be suitably ejected with keeping sufficient speed. Therefore, this arrangement enables adequate printing of a high resolution image.

In a fourth arrangement 4, the decompressor reduces the pressure of the area between the medium and the nozzles to 0.5 atm or less. The decompressor preferably reduces the pressure of the area between the medium and the nozzles to 0.1 atm or less, more preferably 0.01 atm or less. This arrangement can largely reduce the influence of air resistance.

In a fifth arrangement, an inkjet printer of a type printing using an inkjet method is provided that includes an inkjet head having nozzles for ejecting ink to a medium, wherein the ink contains as its main component at least one of monomer and oligomer and is curable by polymerization of the main component, wherein the saturated vapor pressure of the main component of the ink is 10 mmHg or less, and wherein the pressure of at least an area between the medium and the nozzles of the inkjet head is reduced to a value lower than the normal atmospheric pressure. This arrangement can achieve the same effects as those of the first arrangement, for example.

In a sixth arrangement, a printing method for printing using an inkjet method is provided that includes: using ink which contains as its main component at least one of monomer and oligomer and is curable by polymerization of the main component, and in which the saturated vapor pressure of the main component of the ink is 10 mmHg or less; reducing the pressure of at least an area between a medium and nozzles of an inkjet head to a value lower than the normal atmospheric pressure; and ejecting the ink to the medium from the nozzles of the inkjet head. This arrangement can achieve the same effects as those of the first arrangement, for example.

According an embodiment of the present invention, for example, the influence of air resistance on ink droplets ejected from an inkjet head can be sufficiently and suitably reduced.

The present invention can be suitably applied to a printing system, for example.

It should be noted that the exemplary embodiments depicted and described herein set forth the preferred embodiments of the present invention, and are not meant to limit the scope of the claims hereto in any way. Numerous modifications and variations of the present invention are possible in light of the above teachings. It is therefore to be understood that, within the scope of the appended claims, the invention may be practiced otherwise than as specifically described herein.

What is claimed is:

1. A printing system comprising:

a decompression chamber;

an inkjet head having nozzles to eject ink to a medium, said inkjet head being provided within said decompression chamber; and a decompressor configured to reduce pressure within said decompression chamber including an area between the medium and said nozzles of said inkjet head to a value lower than an atmospheric pressure of 1 atm, wherein said ink contains as a main component at least one of a monomer and an oligomer, and is curable by polymerization of the main component, wherein an amount of said main component in said ink is more than 50% of a total amount of said ink, and wherein a saturated vapor pressure of said main component of said ink is 10 mmHg or less.

2. The printing system as claimed in claim 1, wherein said ink further contains an initiator for the polymerization, and wherein the saturated vapor pressure of said initiator is 10 mmHg or less.

3. The printing system as claimed in claim 1, wherein said inkjet head ejects ink droplets, each having a volume of 1 picoliter or less, from said nozzles.

4. The printing system as claimed in claim 1, wherein said decompressor is configured to reduce the pressure of the area between the medium and said nozzles to 0.5 atm or less.

5. The printing system as claimed in claim 1, wherein the amount of said main component in said ink is 65% or more of the total amount of said ink.

6. The printing system as claimed in claim 5, wherein the amount of said main component in said ink is 65% to 85% of the total amount of said ink.

7. The printing system as claimed in claim 1, wherein said main component contains both said monomer and said oligomer.

8. An inkjet printer comprising:

a decompression chamber; and an inkjet head having nozzles to eject ink to a medium, said inkjet head being provided within said decompression chamber, wherein said ink contains as a main component at least one of a monomer and an oligomer, and is curable by polymerization of the main component, wherein an amount of said main component in said ink is more than 50% of a total amount of said ink, wherein a saturated vapor pressure of said main component of said ink is 10 mmHg or less, and wherein a pressure within said decompression chamber including an area between the medium and said nozzles of said inkjet head is reduced to a value lower than an atmospheric pressure of 1 atm.

9. The inkjet printer as claimed in claim 8, wherein said ink further contains an initiator for the polymerization, and wherein the saturated vapor pressure of said initiator is 10 mmHg or less.

10. The inkjet printer as claimed in claim 8, wherein said inkjet head ejects ink droplets, each having a volume of 1 picoliter or less, from said nozzles.

11. The inkjet printer as claimed in claim 8, wherein the amount of said main component in said ink is 65% or more of the total amount of said ink.

12. The inkjet printer as claimed in claim 11, wherein the amount of said main component in said ink is 65% to 85% of the total amount of said ink.

13. The inkjet printer as claimed in claim 8, wherein said main component contains both said monomer and said oligomer.

14. A printing method comprising:

using ink which contains as a main component at least one of a monomer and an oligomer, and is curable by polymerization of the main component, and in which a saturated vapor pressure of said main component of said ink is 10 mmHg or less, wherein an amount of said main component in said ink is more than 50% of a total amount of said ink;

reducing a pressure within a decompression chamber, within which an inkjet head is provided, including an area between a medium and nozzles of said inkjet head to a value lower than an atmospheric pressure of 1 atm; and ejecting said ink to said medium from said nozzles of said inkjet head.

15. The printing method as claimed in claim 14, wherein said ink further contains an initiator for the polymerization, and wherein the saturated vapor pressure of said initiator is 10 mmHg or less.

16. The printing method as claimed in claim 14, wherein said inkjet head ejects ink droplets, each having a volume of 1 picoliter or less, from said nozzles.

17. The printing method as claimed in claim 14, wherein the pressure of the area between the medium and said nozzles is reduced to 0.5 atm or less.

18. The printing method as claimed in claim 14, wherein the amount of said main component in said ink is 65% or more of the total amount of said ink.

19. The printing method as claimed in claim 18, wherein the amount of said main component in said ink is 65% to 85% of the total amount of said ink.

20. The printing method as claimed in claim 14, wherein said main component contains both said monomer and said oligomer.

* * * * *